US005244329A

United States Patent [19]

McGill et al.

[11] Patent Number: 5,244,329

[45] Date of Patent: Sep. 14, 1993

[54] ARRANGEMENT IN A PIPE HANDLING SYSTEM

[75] Inventors: John McGill, Stavanger; Bjorn A. Eilertsen, Hundvag, both of Norway

[73] Assignee: Hitec A.S., Forus, Norway

[21] Appl. No.: 793,418

[22] PCT Filed: May 9, 1990

[86] PCT No.: PCT/NO90/00078

§ 371 Date: Nov. 4, 1991

§ 102(e) Date: Nov. 4, 1991

[87] PCT Pub. No.: WO90/13730

PCT Pub. Date: Nov. 15, 1990

[30] Foreign Application Priority Data

May 12, 1989 [NO] Norway ..... 891944

[51] Int. Cl.[5] ..... E21B 19/00

[52] U.S. Cl. ..... 414/22.63; 175/52; 175/85; 211/70.4

[58] Field of Search ..... 175/52, 85; 414/22.63; 211/70.4; 254/29 R, 30

[56] References Cited

U.S. PATENT DOCUMENTS

| | | | |
|---|---|---|---|
| 2,186,151 | 5/1939 | Roberts | 211/70.4 |
| 2,416,815 | 1/1946 | Calhoun | 414/22.63 |
| 3,658,298 | 4/1972 | Moore et al. | 254/280 |
| 3,949,818 | 4/1976 | Russell | 414/22.63 |
| 3,978,993 | 9/1976 | Howard | 414/22.55 |
| 4,901,805 | 2/1990 | Ali-Zade et al. | 175/85 |
| 5,038,871 | 8/1991 | Dinsdale | 175/52 |

FOREIGN PATENT DOCUMENTS

| | | |
|---|---|---|
| 2918884 | 3/1972 | Fed. Rep. of Germany . |
| 2049539 | 5/1977 | Fed. Rep. of Germany . |
| 154933 | 10/1986 | Norway . |
| 156699 | 7/1987 | Norway . |
| 84/01599 | 4/1984 | World Int. Prop. O. . |

*Primary Examiner*—Joseph E. Valenza
*Assistant Examiner*—Carol Wallace
*Attorney, Agent, or Firm*—Morgan & Finnegan

[57] ABSTRACT

The invention relates to an arrangement in a pipe handling system, especially for handling pipes (4P) in connection with a derrick 1A, wherein the arrangement comprises a tower (1) and two preferably individually controlled operating arms (2*a*, 2*b*). The pipe handling system operates favorably in connection with a finger board (4) in which all fingers (4*a*, 4*n*) are pointing towards the center of the pipe handling system and especially towards a disc-shaped locking unit (4R) mounted on the top of the tower (1), and in connection with a side-step retraction system designed for use with a top drive drilling system.

18 Claims, 9 Drawing Sheets

FIG. 5a
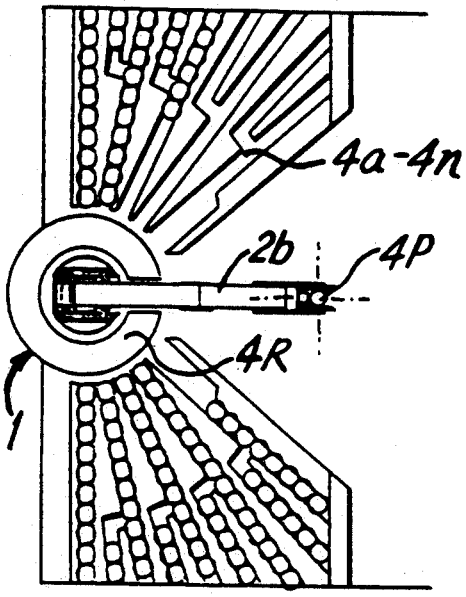
FIG. 5b
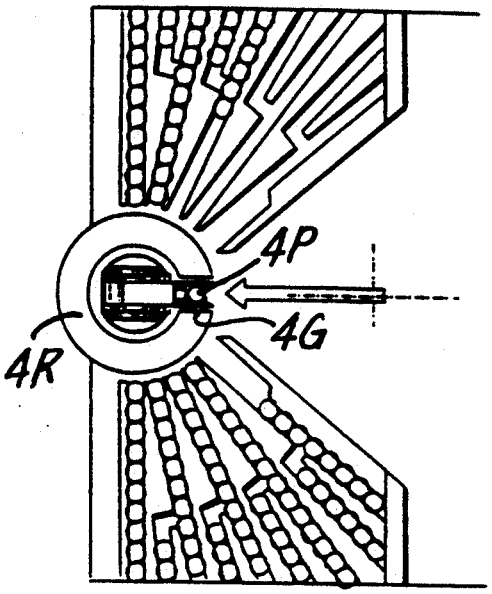
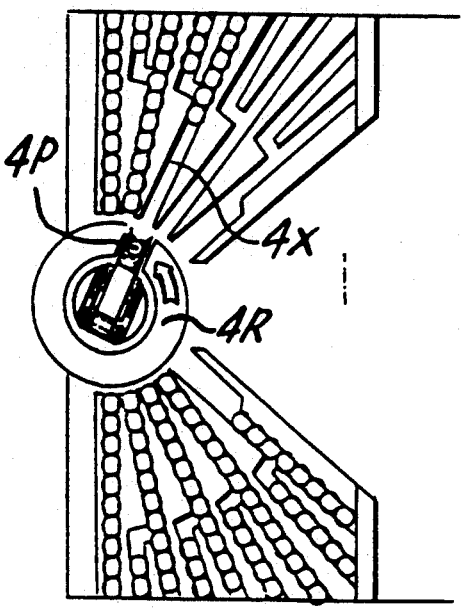
FIG. 5c
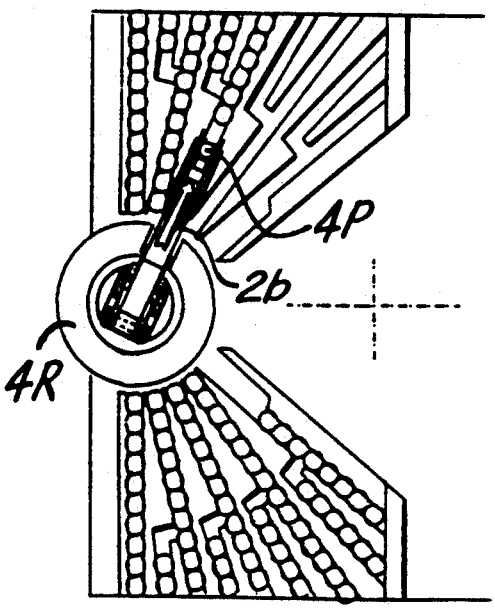
FIG. 5d

ARRANGEMENT IN A PIPE HANDLING SYSTEM

TECHNICAL FIELD

The present invention relates to a pipe handling system, especially a new preferably electrically operated pipe handling system.

The invention also relates to a new type of fingerboard, especially for co-operating with an electrically driven preferably pipe-shaped pipe handling machine.

The invention also relates to a sidestep retraction system.

BACKGROUND OF THE INVENTION

The object of the invention is to provide an improvement in a pipe handling system. The object is achieved by the inventive features as defined in the appended claims and as described in the following.

BRIEF DESCRIPTION OF THE DRAWINGS

FIG. 5*a*–5*d* depict the principle function of the pipe handling according to the present invention, i.e.:

FIG. 5*a* illustrates pipe handling machine grips pipe at well center.

FIG. 5*b* illustrates pipe handling arm retracted for bringing pipe into finger locking ring groove.

FIG. 5*c* illustrates pipe handling arm rotating to select finger.

FIG. 5*d* illustrates pipe handling arms extended for bringing pipe into fingers.

DESCRIPTION OF EMBODIMENTS

With reference to the enclosed drawings, various embodiments of the present invention and various concepts relating thereto, will be described.

Figure 1:
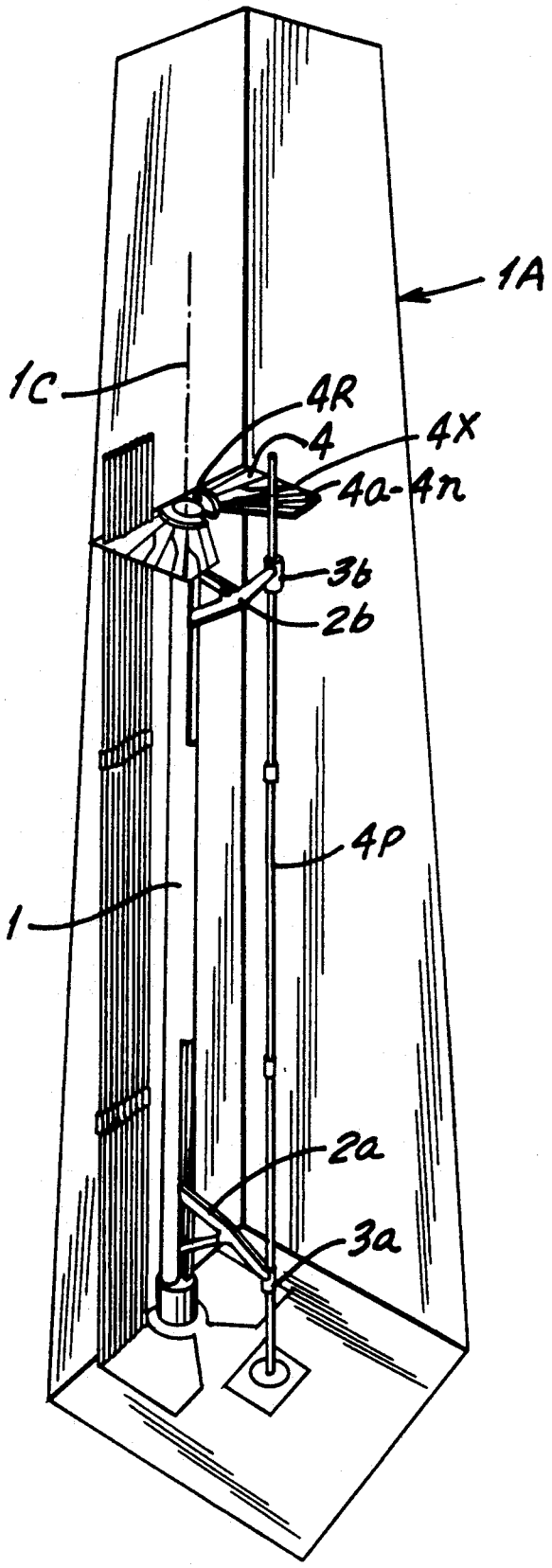
FIG. 1 is a schematic perspective view illustrating an embodiment of an arrangement in a pipe handling system according to the present invention.
Figure 2A:
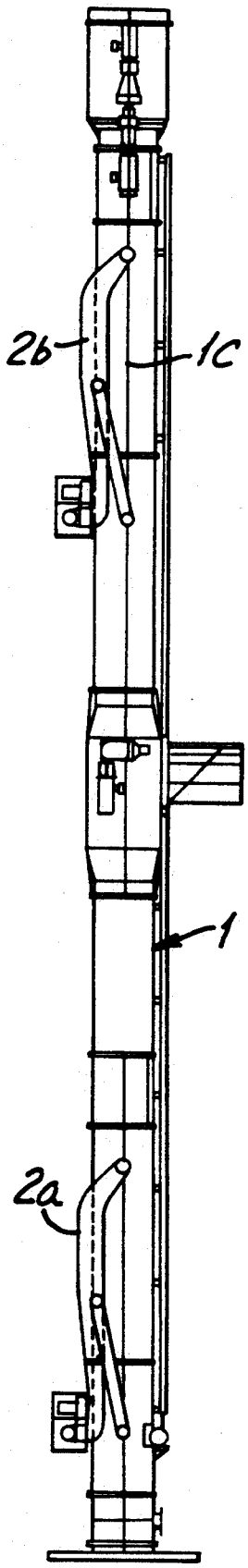
FIG. 2A and 2B are side views of a pipe handling machine included therein.
Figure 2B:
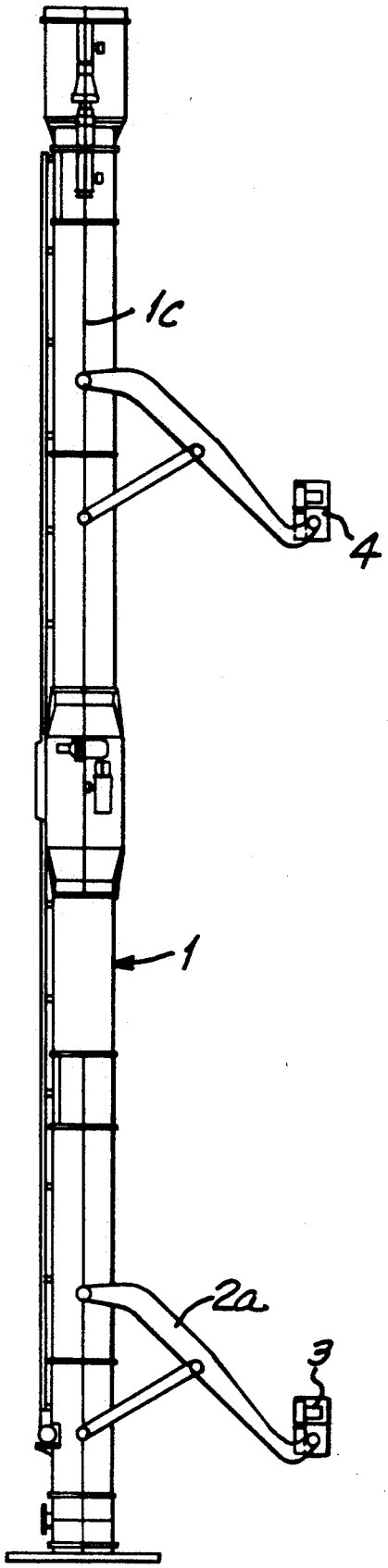
Figure 3:
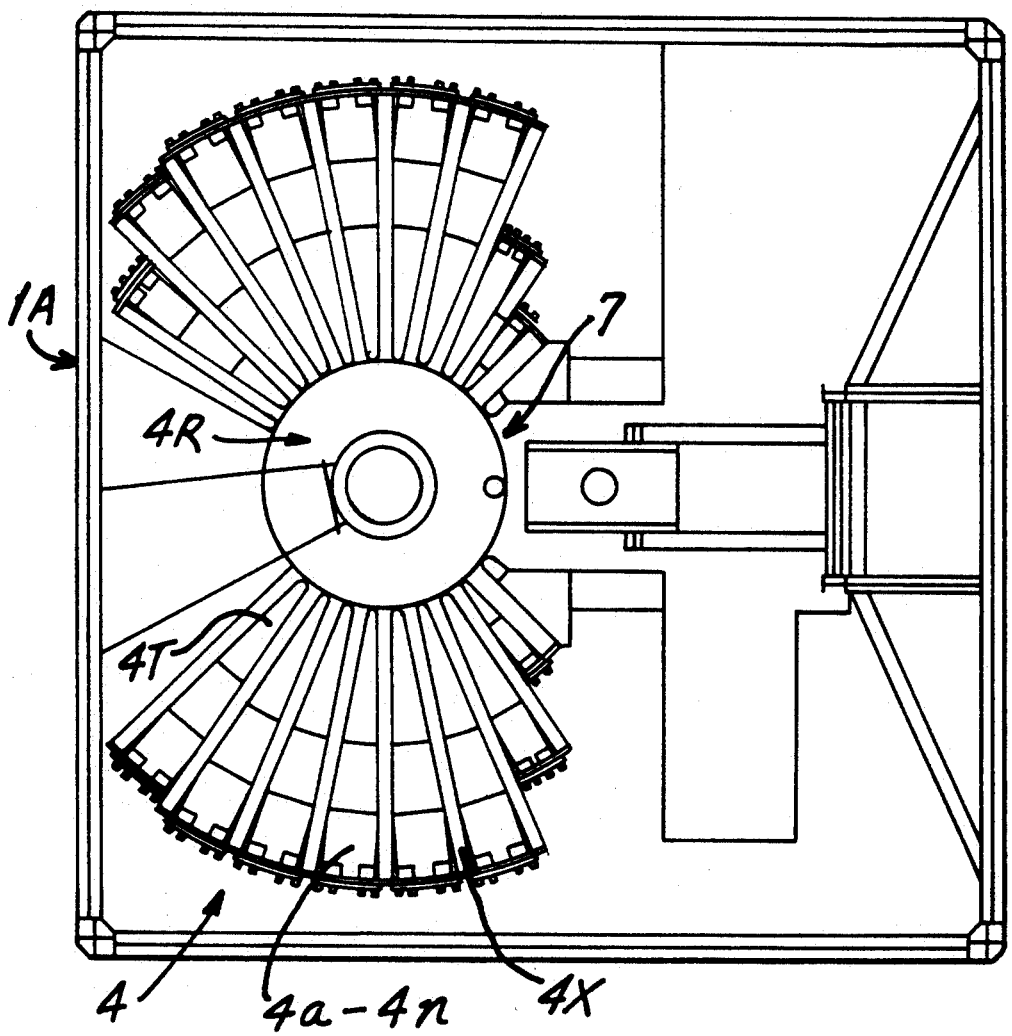
FIG. 3 is a top view of a pipe handling fingerboard included therein.

The pipe handling system and the machine included therein will be built to fit into the derrick or rig floor design 1A. The main principles of the design are illustrated especially in FIGS. 1 and 2A and 2B.

The machine is based on a tower 1 built from for example 700 mm diameter pipe with two operating arms 2*a*, 2*b* built into the tower 1. This gives a very clean outside design. The tower 1 will be fixed in a position in the derrick and rig floor to handle all pipe operations between the well center —fingerboard—mouse hole.

The main load is taken on the rig floor. The pipe is handled by the two independently operated arms 2*a*, 2*b*, which may be compared with scissor arms.

The scissor arm principle used gives a horizontal in-out movement. This principle is easy to control with regard to position accuracy.

Using the scissor arm principle gives a very controlled extended reach. The forces imposed on the tower/arm/carriages are less than on other designs, by using this principle.

All drives are preferably based on A.C. motors with disc brakes driving through gear boxes, which operate on rack and pinion, driving the arms up and down—in and out. The A.C. motors are speed controlled by invertors. Proposed supplier of motor, brake, gear box, invertors is S.E.W. Eurodrive, using standard components. Using A.C. motor drives will give a controlled high speed and a very clean pipe handling machine (no hydraulic leaks).

The pipe handling machine is an independent unit not mechanically connected to the iron roughneck. This has caused problems in other designs including too much downtime due to units connected together. Prior designs also required the pipe handling and iron roughneck work to be carried out very close to the well center, creating the potential for clash problem in pipe handling wit top drive/block. An independent unit, only connected together with the other machines through the control system, iron roughneck, top drive is a better solution.

The upper and lower arms 2*a*, 2*b* are generally of the same design. They are, in the illustrated embodiment, not mechanically connected together, only electrically by the control system. The arms can be operated as independent arms if so required. They can operate at different angles of the pipe. (Other designs have problems with connected arms, as they can only be operated mechanically and are very limited).

A preferred embodiment may be based on a 5" pipe claw (3*a*) with 2 tons lift. The pipe handling machine is designed for high speed tripping of drillpipe. For handling drill collars the machine will only position the drill collars in the set-back using the drawworks to lift the load. This will give a faster pipe handling for more than 95% of the operating time.

Based on 2 tons lift at 2.5 m, it is estimated that the total weight of the machine with supports and fingerboard will be 14.403 Kg.

The claw design is based on a slip principle with an air operating cylinder. This is a fail-safe device. The load has to be removed before the slips can operate. Only the bottom claw 3*a* holds the load. The top claw 3*b* is only used to hold the pipe into position. A load cell is built into the pipe handling machine to give the operator and control system information on weight in the claw. The claws 3*a*, 3*b* will also have a sensor for sensing pipe inside claw.

The control system may be based on a Siemens robotic control system "SIROTEC RMC" and a "SIMATIC S 51354" for operator communication and interfacing with other systems (e.g., iron roughneck, fingerboard, top drive, block position, slips, etc.).

The pipe handling machine is designed to work in a robotic semiautomatic mode with one operator. The operator can also operate in a remote manual mode if so required. The control system is designed for high accuracy, high operating speed, high security—with very good control over interface between other systems.

Maintenance equipment has been considered by using standard motor/gear box/rack and pinion drives, so as to give the rig mechanics and electricians a rapid understanding of the equipment.

The design will reduce the number of personnel working close to the drill pipe 4P. The operator will have a very good communication with the driller. With all pipe positions programmable, the pipe handling controls are very easy to operate. This leads to less work and lower stress which, in turn, increases the safety and efficiency of the operation.

The overall design provides an improved automatic unit compared with existing pipe handling units which are in operation today. The present invention provides especially a favourable combination of electrical and mechanical equipment and control systems to make an effective automatic pipe tripping machine.

FIGS. 3–6 illustrate star fingerboard concept, in which the top element 4 includes fingers 4*a*, 4*n* which are all pointing towards the center of the pipe handling machine 1.

The reason for orientating the fingers 4*a*–4*n* in this manner, is to have the pipe handling machine 1 mounted in a fixed position with a minimum of movements, the machine 1 will turn around its "stationary" vertical axis of rotation 1*c*, and thus manoeuvre its arms 2*a*, 2*b* towards the well center or towards the actual finger, the arms 2*a*, 2*b* then being manoeuvered straight into and out of the pipe holding finger slots 4*x*.

The star fingerboard concept will fit into all types of derricks or masts and the benefits thereof can be listed as follows:

The star fingerboard concept allows a fixed position of the pipe handling machine 1.

A fixed position provides benefits as to:

a) Less movements, easy control b) Slim design, due to less forces, less weight, less space c) Faster and safer pipe handling The star fingerboard 4 will give a good racking capacity.

Locking of fingers will be done very easy with a locking ring 4R around the top of the pipe handling tower 1.

d) The fingers 4*a*–4*n* will be strong with slim tips 4T and wide root 4.

e) The star fingerboard will also be easy to operate manually.

Figure 4C:
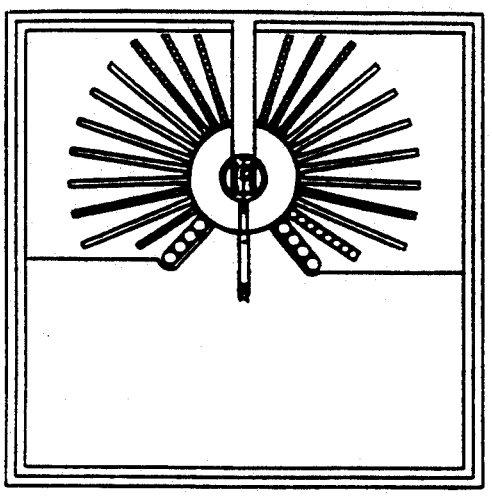
FIG. 4*b*–4*d* illustrates alternative fingerboards according to the invention.
Figure 4D:
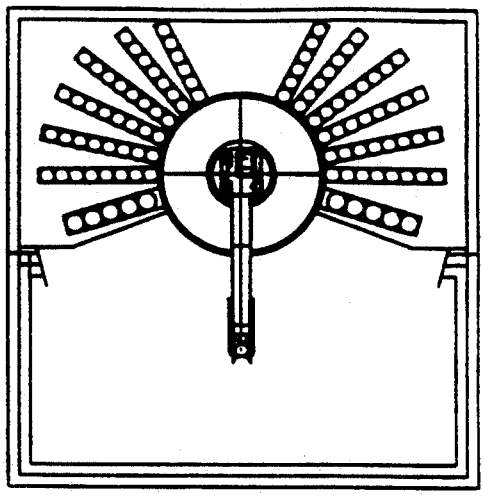
Figure 4A:
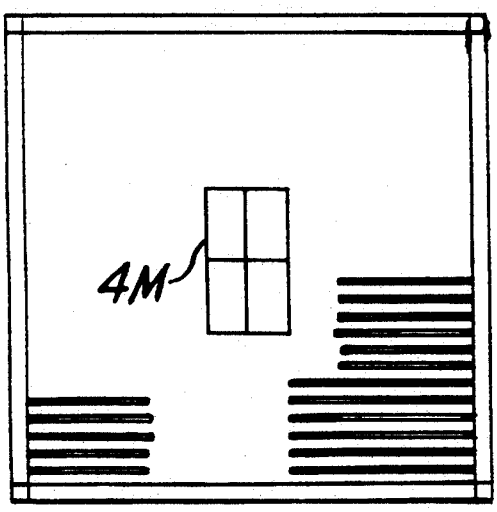
FIG. 4*a* illustrates a prior art fingerboard.

FIG. 4*a* illustrates a prior art fingerboard, in which a mobile unit or wagon 4M must be used for handling the pipes.

Figure 4B:
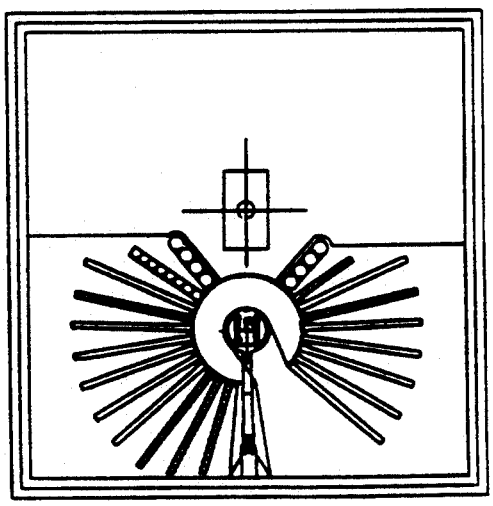

FIG. 4*b*–4*c* illustrate various embodiments of fingerboards adapted to various pipe types and dimensions.

FIG. 5*a*–5*d* depict the principle function of the pipe handling according to the present invention, i.e:

FIG. 5*a* illustrates pipe handling machine arm 2*b* grips pipe 4P at well center.

FIG. 5*b* illustrates pipe handling arm retracted for bringing pipe 4P into finger locking ring groove 4G.

FIG. 5*c* illustrates pipe handling arm rotating to selected fingers or finger slot 4*x*.

FIG. 5*d* illustrates pipe handling arm 2*b* extended for bringing pipe 4P into fingers.

Figure 6A:
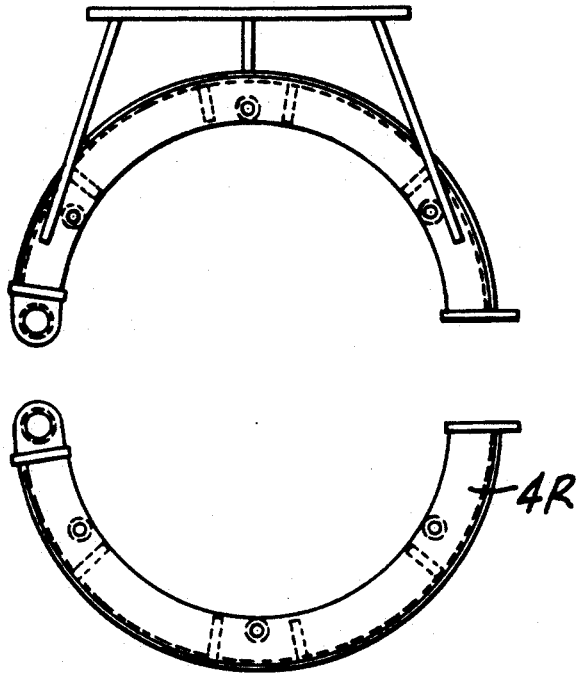
FIG. 6*a*–6*c* are various views of the locking ring of the fingerboard according to the present invention.
Figure 6C:
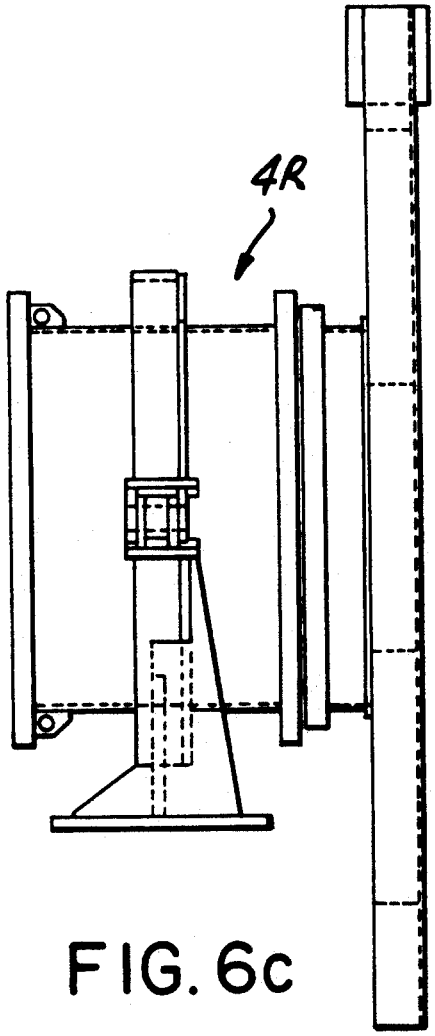
Figure 6B:
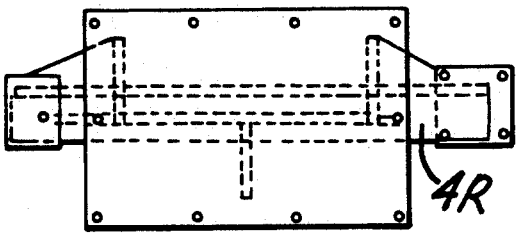
Figure 7D:
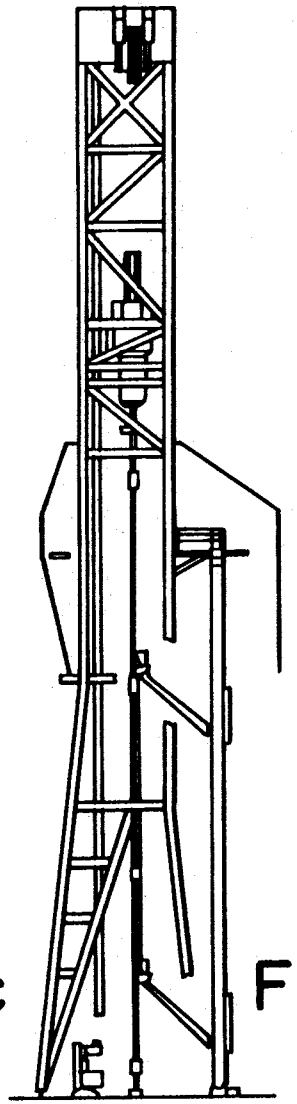
FIG. 7*a*–7*d* illustrate the principles of the operation of the sidestep retraction system according to the present invention.
Figure 7C:
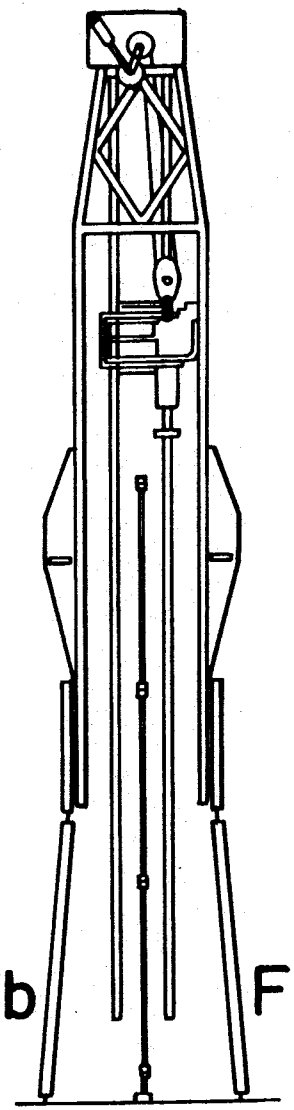
Figure 7B:
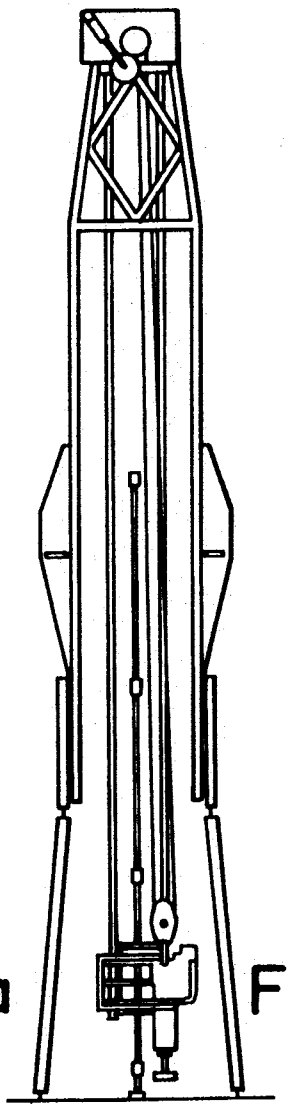
Figure 7A:
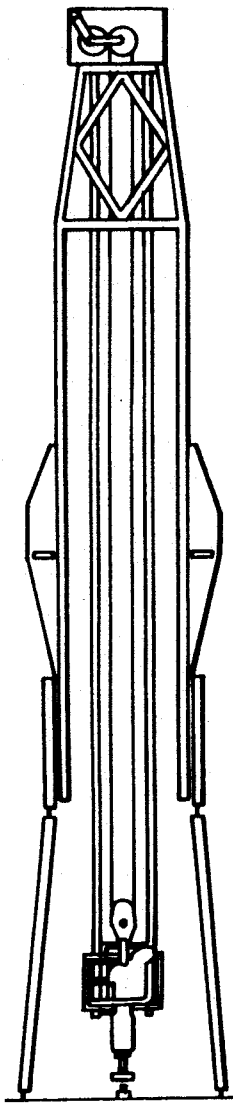
Figure 8:
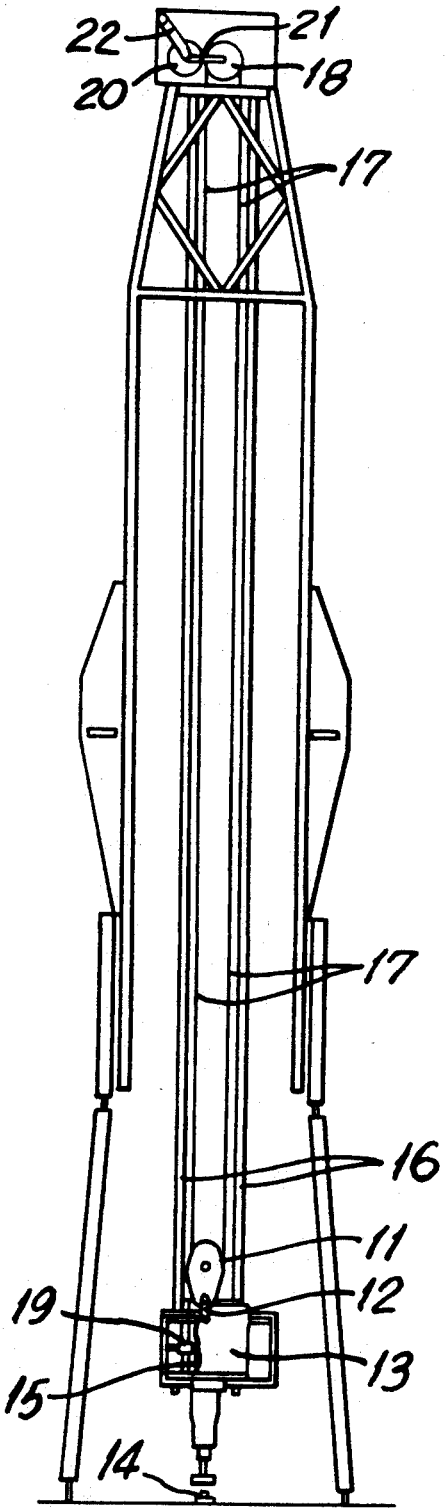
FIG. 8 is a side view of a derrick equipped with a drill block in accordance with the invention, shown centrally placed over the drill pipe.

FIG. 6*a*–6*c* illustrate details of a locking ring 4R.

In FIG. 7–11 there is illustrated a sidestep retraction system which is designed for use with a top drive drilling system.

A top drive drilling system is functioning with a wire block system in the top of the drilling tower. It serves the purpose of lifting and lowering various equipment. An example of such equipment is a drilling machine for the drill pipe to be rotated, which equipment is connected through a joint to the block taking the form of a wagon which is guided by vertical guide rails.

When drilling for water, gas or crude oil it is necessary to bring the drilling block with connected equipment up and down while the drill pipe maintains its drilling position.

Today this problem is solved by retracting the block with equipment between the guide rails and the drill pipe.

This is space consuming and results in unwanted wire bend. The moment of force will, while drilling, become larger and create larger stress factors. This results in increased dimensioning.

This invention can solve some of these problems and make it possible to design a smaller space demanding derrick. It will reduce the moment of force on the guide rails as well as avoid the bended wires when retracting from a symmetric position over the drill pipe.

This is achieved primarily by arranging the drill block decentralized and designed as characterized in the appended claims.

By decentralized design of the drill block, the retracting operation will demand less space. It is of greater importance in space critical area and will result that the construction can be significantly dimensionally reduced compared with previous methods. With this invention the wires will not have negative stress factors.

With reference to enclosed drawings and descriptions, the following will describe an embodiment of a sidestep retraction system.

In FIGS. 7 through 11 of the drawings reference number 11 is a drill block in the derrick. The drill block 11 is connected through a joint link 12 with the equipment unit 13, for example a drilling machine for drilling of the drill pipe 14.

The equipment 13 is guided by a wagon 15 on vertical guide rails 16.

In drilling position the drill block 11 and equipment 13 connected thereto are kept in a central position over the drill pipe 14.

Wires 17 are connected to and from the top block 18 in the top of the derrick.

A hydraulic cylinder operated skid mechanism 19 is connected to the drill block 11, which in turn is mounted on the wagon 15.

In order to change directions of the wire closest to the vertical centerline of the derrick, the top block 18 comprises a turnable roller 20, which by a joint arm 21 is connected to the top block 18. A skid system is arranged by guiding the roller 20 with a hydraulic cylinder 22 connected with a top block 18. The block 18 and the guide roller 20 can exert pressure on the adjacent wire, with the effect of decentering the direction of the wire to a position of choice. This is particularly so when the drill block 11 is in retracted position, see FIGS. 9 and 10, and shown in a broken line in FIG. 11.

When the drill block 11 with connected equipment 13 is retracted to give space for a new drill pipe section 14', the hydraulic cylinder 19 is activated and will bring the drill block 11 decentralized (sideways) position away from the central area over the drill pipe. This opens the possibility to connect new drill pipe sections 14' even before the drill block 11 is retracted to upper position.

In order to also move the wire 17 in the same direction as the drill block 11 and bring this also sideways away from the central area in the derrick, the hydraulic cylinder 22 at the top block 18 moves the skid roller 20 against the adjoining pair of wires 17.

Figure 9:
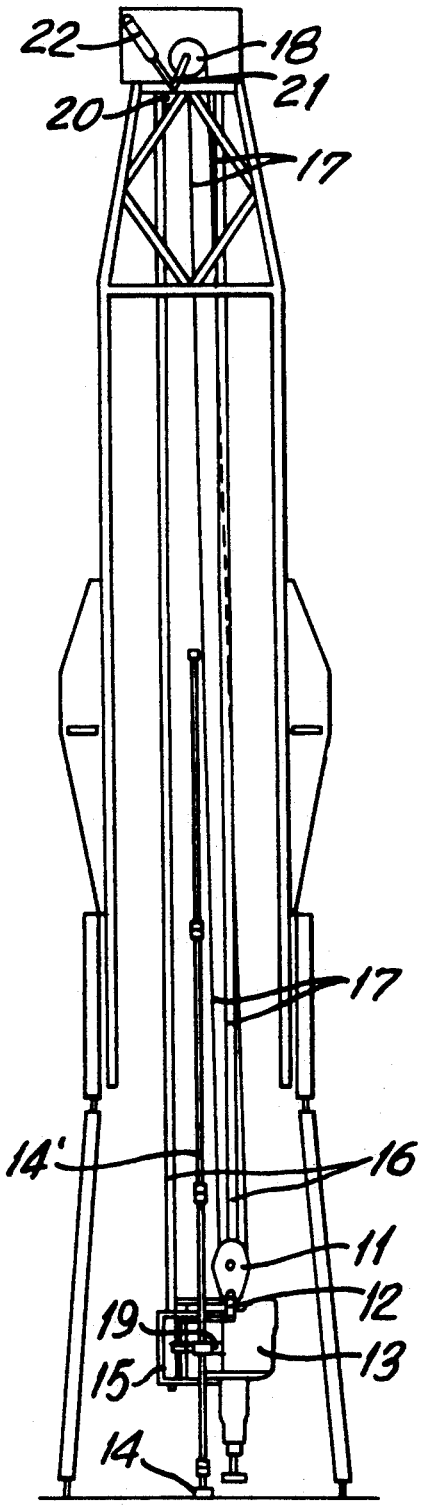
FIG. 9 is a side view where the drill block is retracted from the central position to have connected thereto additional drill pipe sections
Figure 10:
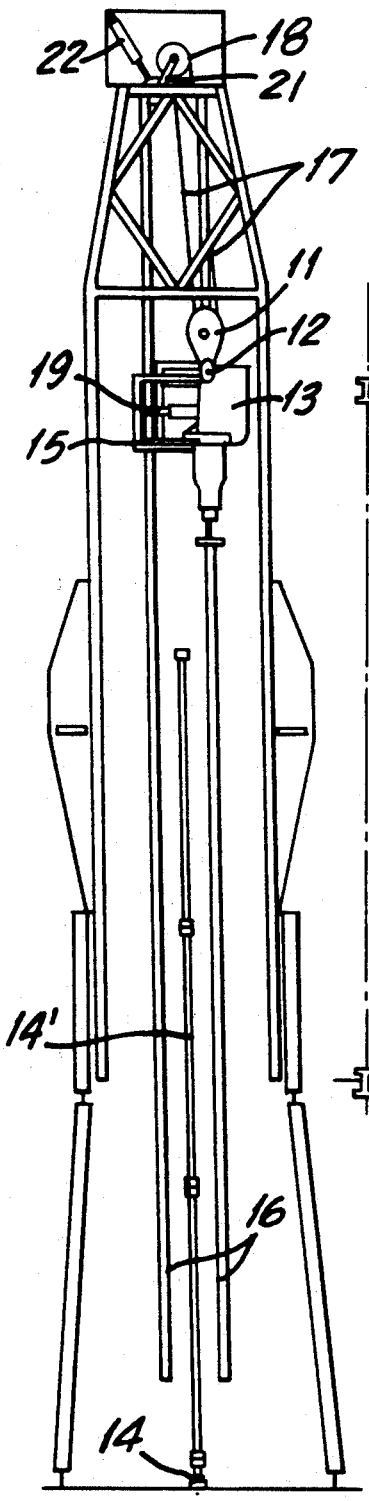
FIG. 10 shows the arrangement in same position as FIG. 9, but where the drill block and connected equipment are in upper position.
Figure 11:
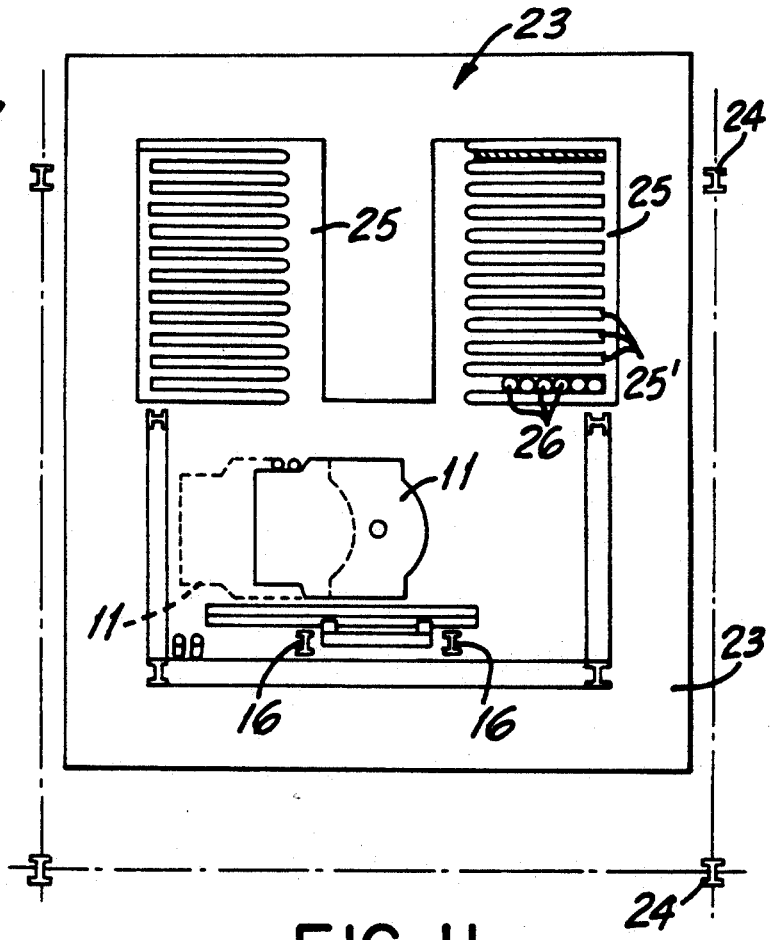
FIG. 11 shows the arrangement in plan view and horizontal section.

When the drill block with connected equipment including the wire is brought to a retracted position, the parts shown in FIGS. 9 and 10 will take the position as shown by the broken line in FIG. 11.

FIG. 11 illustrates the platform deck 23, the derrick 24 and the fingerboard 25 where drill pipe sections are stored in a vertical position. The various drill pipes can be transported between the fingerboard 25 and the mousehole with the use of the pipe handling machine previously discussed, and with a fingerboard arrangement as illustrated in FIG. 5a–5d.

In accordance to the invention the retracted drill block 11 is laterally decentralized, which means that the center axis is parallelly moved.

This movement, as shown in FIG. 11, will take place by moving the drill block 11 parallel to the guide rails 16 as well as the fingerboard slots 25'.

This system creates less moment forces and demands less space than conventional known methods where the drill block is retracted between the guide rails 16 and the drill pipe 14 towards the outer limits of the derrick.

With the guided wires at the top block, no negative factors will occur, as with the normal techniques.

What is claimed is:

1. Arrangement in a pipe handling system for handling pipes in connection with a derrick, said derrick comprising a pipe shaped tower (1) and operating arms (2a, 2b) for handling pipe lengths between a finger board pipe storage unit (4) and a well center, characterized in that the finger board pipe storage unit (4) includes stationary fingers (4a–4n) which are all pointing and opening towards a common center around said pipe-shaped tower (1) which is mounted in said derrick.

2. Arrangement according to claim 1, characterized in that the fingers (4a–4n) are of various sizes and configurations so as to allow for various gaps (4x) therebetween.

3. Arrangement according to claim 1, characterized in that the pipe-shaped tower (1) comprises two arms (2a, 2b) which are operated individually.

4. Arrangement according to claim 3, characterized in that the operating arms (2a, 2b) co-operate as scissor arms, so as to handle pipes (4P) in substantially horizontal or skew position and move said pipes back and forth.

5. Arrangement according to claim 1, characterized in that it includes drives for driving the arms (2a, 2b) up and down and in and out.

6. Arrangement according to claim 5, characterized in that the drives are based on AC motors.

7. Arrangement according to claim 1, characterized in that the pipe handling system constitutes an arrangement which is independent of the iron roughneck.

8. Arrangement according to claim 1, characterized in that each arm (2a, 2b) is provided at its free end with a pipe claw (3a, 3b).

9. Arrangement according to claim 8, characterized in that the pipe claw (3a) associated with the lower arm (2a) is designed to catch the pipe load and the claw (3b) associated with the upper arm (2b) is designed to position the pipe (4P).

10. Arrangement in a pipe handling system according to claim 1, characterized in that it includes a sidestep retraction system (18–22) and is designed for use with a top drive drilling system.

11. Arrangement according to claim 10, characterized in that the sidestep retraction system (18–22) can be fitted into a standard derrick.

12. Arrangement according to claim 11, including a derrick (24) with a drill block (11) which can be retracted by wires (17) running to and from a top block (18) and through joint connections (22) for transporting equipment units (13) on a wagon (15) guided by vertical guide rails (16), said drill block (11) being retractable from its central position over the drill pipe (14) and adapted to be parallelly shifted sideways.

13. Arrangement according to claim 12, characterized in that a wire guide apparatus (20) is provided in the area of the top block (18) to activate wires (17) by pressure and to move said wires (17) in the same direction as the drill block (11).

14. Arrangement according to claim 13, characterized in that it includes a hydraulic cylinder skid mechanism (19) arranged between the drill block (11) and the wagon (15) for equipment (13).

15. Arrangement according to claim 1, characterized in that the pipe shaped tower (1) is stationarily mounted in the derrick.

16. Arrangement according to claim 1, characterized in that the pipe shaped tower (1) is rotatably mounted in said derrick.

17. Arrangement in a pipe handling system for handling pipes in connection with a derrick, said derrick comprising a pipe shaped tower (1) and operating arms (2a, 2b) for handling pipe lengths between a finger board pipe storage unit (4) and a well center, characterized in that the finger board pipe storage unit (4) includes stationary fingers (4a–4n) which are all pointing and opening towards a common center around said pipe shaped tower (1) which is mounted in said derrick, said stationary fingers (4a–4n) being of various sizes and configurations so as to allow for various gaps (4x) therebetween and said pipe shaped tower (1) comprising a top mounted disk- or ring- shaped unit (4R) operating as a locking device for said finger board pipe storage unit (4).

18. Arrangement in a pipe handling system for handling pipes in connection with a derrick, said derrick comprising a pipe shaped tower (1) and operating arms (2a, 2b) for handling pipe lengths between a finger board pipe storage unit (4) and a well center, characterized in that the finger board pipe storage unit (4) includes stationary fingers (4a–4n) which are all pointing and opening towards a common center around said pipe shaped tower (1) which is mounted in said derrick, said stationary finger s(4a–4n) being of various sizes and configurations so as to allow for various gaps (4x) therebetween, and said pipe shaped tower (1) comprising a top mounted disk- or ring- shaped unit (4R) operating as a locking device for said finger board pipe storage unit (4) and having a slit opening (4G) extending in the same direction as the main operating plane of said operating arms (2a, 2b) of said pipe shaped tower (1).

* * * * *